US009676592B2

(12) United States Patent
Wells et al.

(10) Patent No.: US 9,676,592 B2
(45) Date of Patent: Jun. 13, 2017

(54) TRACTION ELEVATOR ROPE MOVEMENT SENSOR SYSTEM

(71) Applicant: ThyssenKrupp Elevator Corporation, Alpharetta, GA (US)

(72) Inventors: Luther Wells, Lewisville, TX (US); Dennis Farrar, Memphis, TN (US); Scott Lahmers, Dallas, GA (US); Phillip Hampton, Cordova, TN (US)

(73) Assignee: THYSSENKRUPP ELEVATOR CORPORATION, Alpharetta, GA (US)

( * ) Notice: Subject to any disclaimer, the term of this patent is extended or adjusted under 35 U.S.C. 154(b) by 0 days.

(21) Appl. No.: 14/748,600

(22) Filed: Jun. 24, 2015

(65) Prior Publication Data

US 2016/0376125 A1 Dec. 29, 2016

(51) Int. Cl.
*B66B 5/02* (2006.01)
*B66B 3/00* (2006.01)
(Continued)

(52) U.S. Cl.
CPC ..... *B66B 5/02* (2013.01); *B66B 5/0031* (2013.01); *B66B 5/022* (2013.01); *B66B 7/068* (2013.01); *B66B 11/0065* (2013.01)

(58) Field of Classification Search
CPC B66B 7/068; B66B 7/10; B66B 5/022; B66B 5/125; B66B 5/0031; B66B 3/002
See application file for complete search history.

(56) References Cited

U.S. PATENT DOCUMENTS 5,861,084 A 1/1999 Barker et al.
5,886,308 A 3/1999 Ericson et al.
(Continued)

FOREIGN PATENT DOCUMENTS

JP 2001316058 A * 11/2001
JP 2006124102 A * 5/2006
WO 2010013597 2/2010

OTHER PUBLICATIONS

International Search Report and Written Opinion for International Application No. PCT/US2016/038635 mailed Oct. 24, 2016, 7 pages.

*Primary Examiner* — William A Rivera
*Assistant Examiner* — Stefan Kruer
(74) *Attorney, Agent, or Firm* — Remarck Law Group PLC

(57) ABSTRACT

An elevator system constructed in accordance to one embodiment of the present disclosure includes an elevator car, a counterweight, a sheave assembly, a suspension rope, a compensation rope, a first optical sensor assembly and a controller. The suspension rope has a first suspension end coupled to the elevator car and a second suspension end coupled to the counterweight. The first compensation rope has a first compensation end coupled to the elevator car and a second compensation end coupled to the counterweight. The first optical sensor assembly can have a first optical sensor pair including a first emitter and a first receiver. The first emitter is configured to emit a first beam to be received by the first receiver. The first optical sensor pair is configured to detect interruption of the first beam by the first compensation rope. The controller controls movement of the elevator car based on the detected interruption.

19 Claims, 5 Drawing Sheets

(51) Int. Cl.

| | |
|---|---|
| ***B66B 7/06*** | (2006.01) |
| ***B66B 5/00*** | (2006.01) |
| *B66B 11/08* | (2006.01) |
| *B66B 11/00* | (2006.01) |

(56) References Cited

U.S. PATENT DOCUMENTS

| | | | | |
|---|---|---|---|---|
| 6,488,125 | B1 * | 12/2002 | Otsuka | B66B 7/068 187/254 |
| 9,327,942 | B2 * | 5/2016 | Fukui | B66B 5/022 |
| 2005/0133312 | A1 * | 6/2005 | Kaczmarek | B66B 7/068 187/266 |
| 2008/0271954 | A1 | 11/2008 | Fischer | |
| 2013/0133983 | A1 | 5/2013 | Mangini et al. | |
| 2013/0173206 | A1 | 7/2013 | Benosman et al. | |
| 2013/0206515 | A1 | 8/2013 | Quinn | |
| 2013/0275081 | A1 | 10/2013 | Benosman et al. | |
| 2014/0000985 | A1 * | 1/2014 | Fukui | B66B 5/0031 187/247 |
| 2014/0069747 | A1 | 3/2014 | Benosman | |
| 2014/0124300 | A1 | 5/2014 | Benosman | |
| 2014/0229011 | A1 | 8/2014 | Fukui et al. | |
| 2014/0305744 | A1 | 10/2014 | Kere et al. | |
| 2015/0008075 | A1 | 1/2015 | Benosman et al. | |

* cited by examiner

TRACTION ELEVATOR ROPE MOVEMENT SENSOR SYSTEM

FIELD

The present disclosure relates generally to elevator systems and more specifically to a rope movement sensor system incorporated in the elevator system.

BACKGROUND

Elevators are used in multi-floor buildings to transport passengers to various floors throughout the building. In elevator systems installed in high elevation buildings, compensation ropes can be subject to excessive movement due to changing environmental conditions which results in building sway. Such movement may cause an entanglement condition of the compensation ropes which can lead to rope damage or damage to other equipment. Further, suspension ropes can also be subject to excessive movement which may cause the suspension ropes to vibrate resulting in passenger discomfort and/or equipment shutdown.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An elevator system constructed in accordance to one embodiment of the present disclosure includes an elevator car, a counterweight, a sheave assembly, a suspension rope, a compensation rope, a first optical sensor assembly and a controller. The sheave assembly can have a suspension sheave portion and a compensation sheave portion that guides the elevator car on a car side of the sheave assembly and guides the counterweight on a counterweight side of the sheave assembly. The suspension rope can pass over and be guided by the suspension sheave portion. The suspension rope can have a first suspension end coupled to the elevator car on the car side and a second suspension end coupled to the counterweight on the counter weight side. The first compensation rope can pass around the compensation sheave portion. The first compensation rope can have a first compensation end coupled to the elevator car on the car side and a second compensation end coupled to the counterweight on the counterweight side. The first optical sensor assembly can have a first optical sensor pair including a first emitter and a first receiver. The first emitter can be configured to emit a first beam to be received by the first receiver. The first optical sensor pair can be configured to detect interruption of the first beam by the first compensation rope. The controller can control movement of the elevator car based on the detected interruption.

According to additional features, the first optical sensor pair can be configured on the counterweight side of the sheave assembly. In some embodiments the first optical sensor pair can be configured on the car side of the sheave assembly.

In some embodiments, the elevator system can further comprise a second optical sensor assembly configured on the car side of the sheave assembly. The second optical sensor can comprise a first optical sensor pair including a first emitter and a first receiver. The first emitter can be configured to emit a first beam to be received by the first receiver. The first optical sensor pair can be configured to detect interruption of the first beam by the first compensation rope.

The elevator system can additionally include a second compensation rope that passes around the compensation sheave portion. The first optical sensor assembly can further include a second optical sensor pair including a second emitter and a second receiver. The second emitter can be configured to emit a second beam to be received by the second receiver. The second optical sensor pair can be configured to detect interruption of the second beam by the second compensation rope. In one embodiment, the first optical sensor pair and the second optical sensor pair are arranged to each detect interruption upon movement of the first and second compensation ropes toward each other.

According to other features the first optical sensor assembly can further include a first transverse pair of optical sensors including a first transverse emitter and a first transverse receiver. The first transverse emitter can be configured to emit a first transverse beam to be received by the first transverse receiver. The first optical sensor pair is arranged to emit the first beam in a first direction and the first transverse pair of optical sensors are arranged to emit the first transverse beam in a second direction. The first and second directions are transverse relative to each other.

According to still other features, the first optical sensor assembly can additionally include a third optical sensor pair including a third emitter and a third receiver. The third emitter can be configured to emit a third beam to be received by the third receiver. The third optical sensor pair can be arranged to emit the third beam in a third direction. The first and third directions are parallel to each other. The first and third optical sensor pairs are positioned on opposite sides of the first compensation rope.

In some embodiments, the elevator system further includes at least one of: a third optical sensor assembly, a fourth optical assembly, and a fifth optical assembly. Each of the third, fourth, and fifth optical sensor assemblies having a first suspension optical sensor pair including a first suspension emitter configured to emit a first suspension beam to be received by a first suspension receiver. The first suspension optical sensor pair can be configured to detect interruption of the first suspension beam by the suspension rope. The third optical sensor assembly can be positioned in the elevator system proximate the suspension sheave. The fourth optical sensor assembly can be positioned in the elevator system proximate the elevator car. The fourth optical sensor assembly can be positioned in the elevator system substantially midway between the suspension sheave portion and the compensation sheave portion.

The first optical sensor pair can be positioned at a location such that the first beam is 0.25 inches away from the first compensation rope when the first compensation rope is in a static position. The first and second transverse optical sensor pairs can be offset 3.5 inches from each other.

BRIEF DESCRIPTION OF THE DRAWINGS

The present disclosure will become more fully understood from the detailed description and the accompanying drawings, wherein.

DETAILED DESCRIPTION

Figure 1:
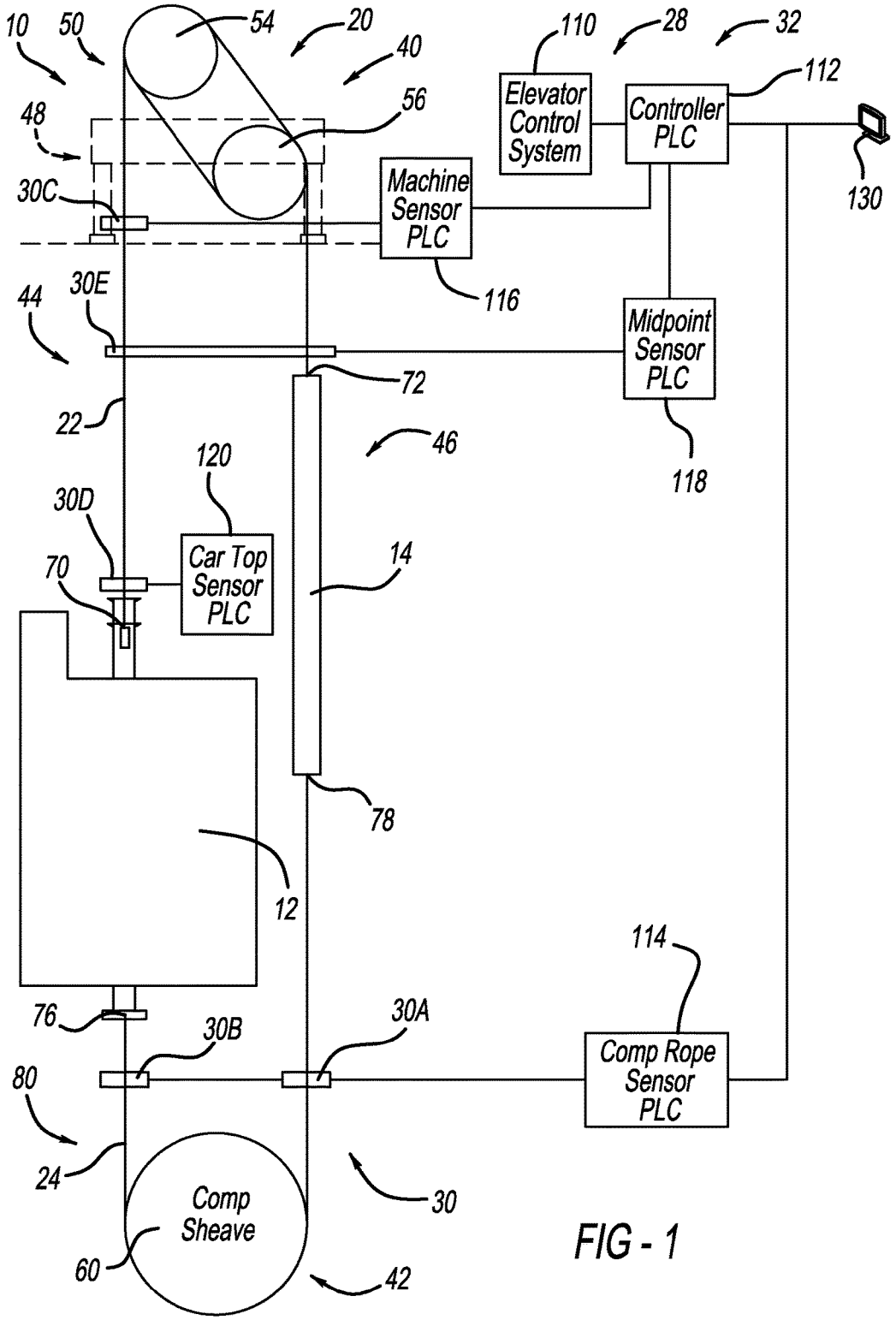
FIG. 1 is a schematic illustration of an exemplary elevator system having a rope movement sensor system constructed in accordance to one embodiment of the present disclosure.

With initial reference to FIG. 1, a schematic illustration of an elevator system constructed in accordance to one embodiment of the present teachings is shown and generally identified at reference numeral 10. The elevator system 10 generally includes an elevator car 12, a counterweight 14, a sheave assembly 20, a suspension rope 22, a compensation rope 24, and a rope movement sensor system 28. The rope movement sensor system 28 can include an optical sensor assembly, collectively identified at reference 30 and a control system 32. The sheave assembly 20 can generally include a suspension sheave portion 40 and a compensation sheave portion 42 that guides the elevator car 12 on a car side 44 of the sheave assembly 20 and guides the counterweight 14 on a counterweight side 46 of the sheave assembly 20. In some embodiments, the suspension sheave portion 40 can be located in a machine room 48 at the top of an elevator hoistway 50. In the embodiment shown the suspension sheave portion 40 includes a drive sheave 54 and a secondary sheave 56. The compensation sheave portion 42 includes a compensation sheave 60. Other configurations are contemplated.

The suspension rope 22 can be passed over and guided by the suspension sheave portion 40. The suspension rope 22 can have a first suspension end 70 coupled to the elevator car 12 on the car side 44 of the sheave assembly 20 and a second suspension end 72 coupled to the counterweight 14 on the counterweight side 46 of the sheave assembly 20. The compensation rope 24 can be passed around the compensation sheave portion 42. The compensation rope 24 can have a first compensation end 76 coupled to the elevator car 12 on the car side 44 of the sheave assembly 20 and a second compensation end 78 coupled to the counterweight 14 on the counterweight side 46 of the sheave assembly 20. As will become appreciated from the following discussion, while the illustration shown in FIG. 1 has identified a single suspension rope 22 and a single compensation rope 24, both the suspension rope 22 and the compensation rope 24 can comprise multiple ropes.

Figure 2:
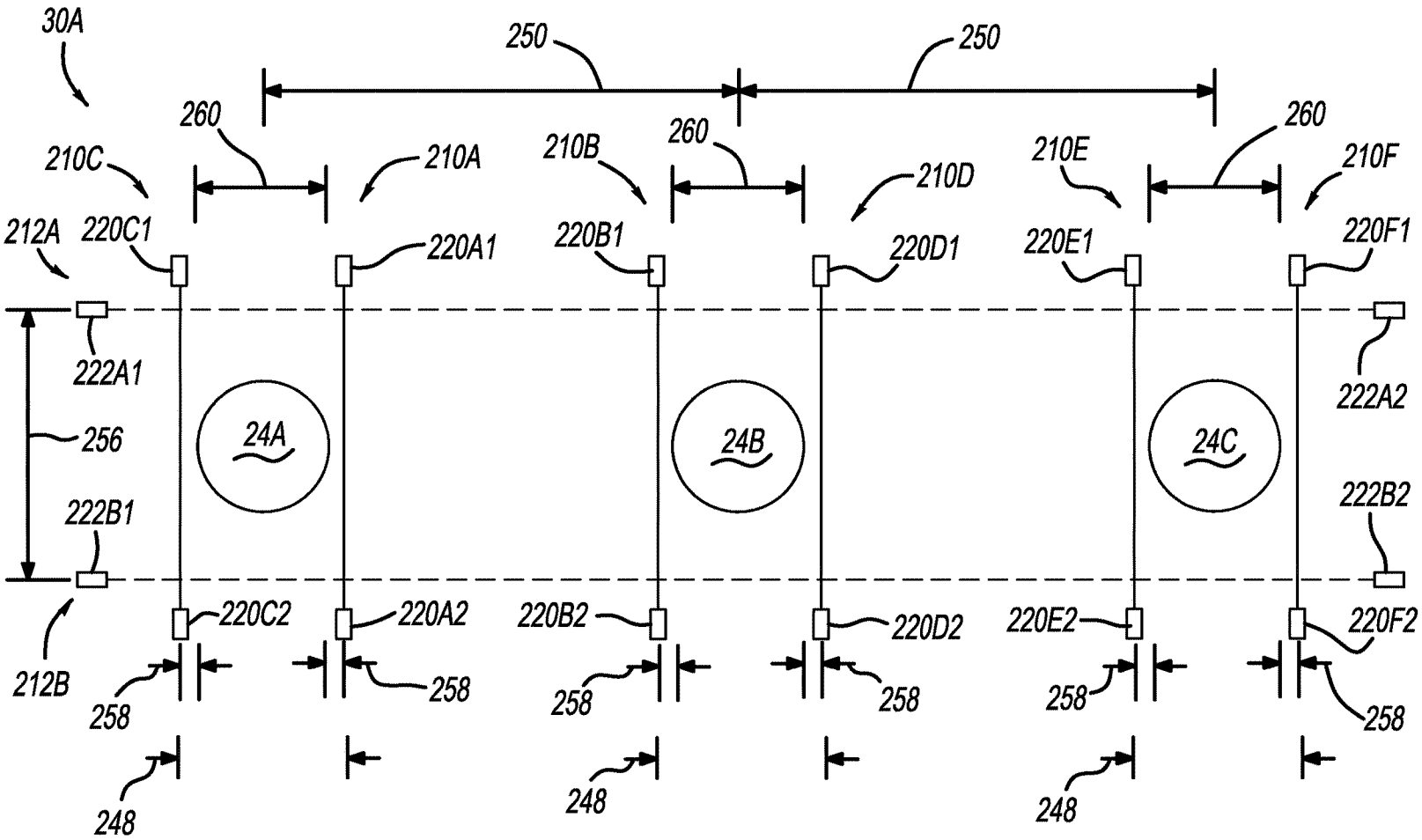
FIG. 2 is a cross-sectional plan view of an optical sensor assembly configured on the counterweight side of the compensation sheave in an embodiment of the elevator system of FIG. 1.
Figure 3:
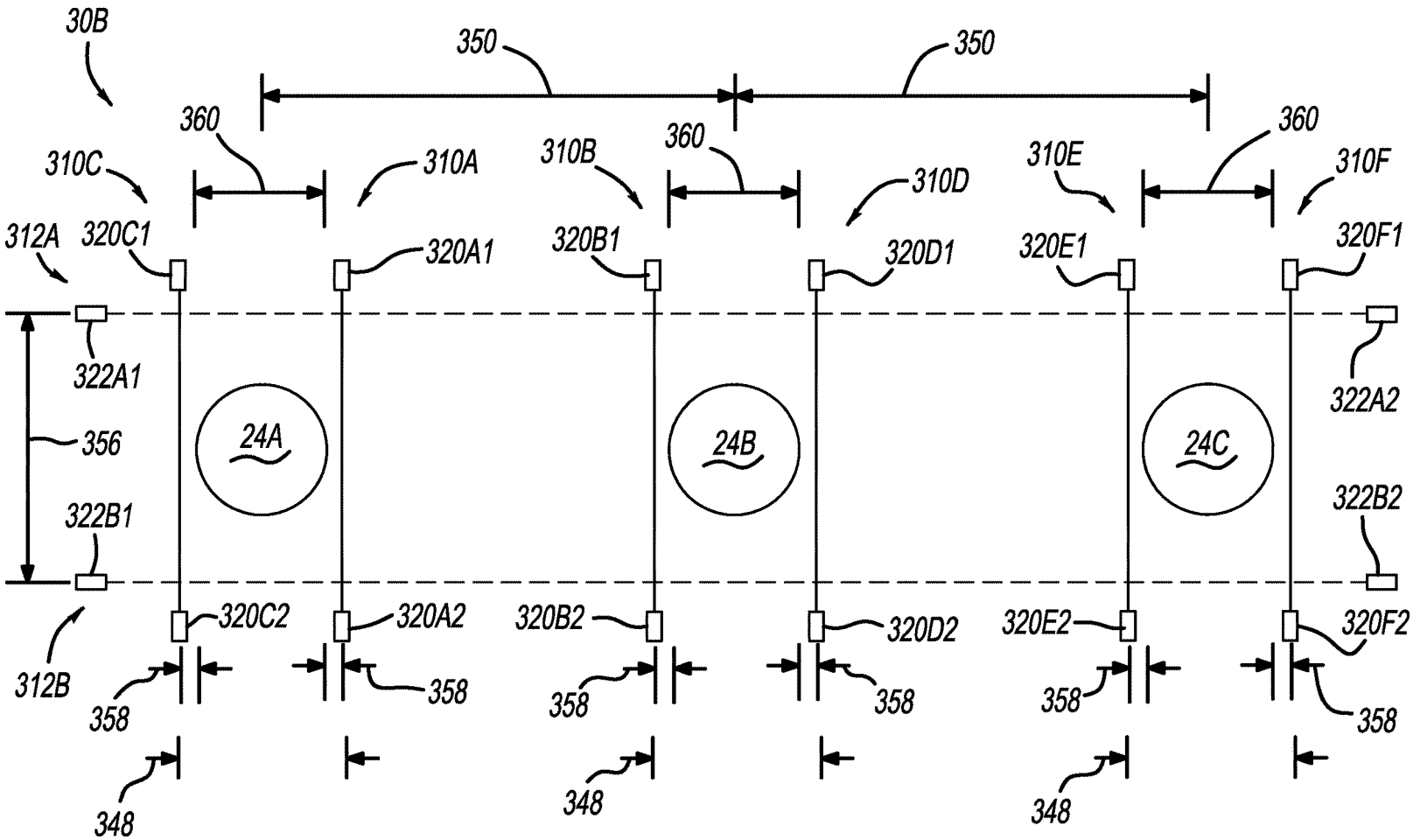
FIG. 3 is a cross-sectional plan view of an optical sensor assembly configured on the car side of the compensation sheave in an embodiment of the elevator system of FIG. 1.

The optical sensor assembly 30 can include a first optical sensor assembly 30A (FIG. 2) and a second optical sensor assembly 30B (FIG. 3). The first optical sensor assembly 30A can be configured on the counterweight side 46 of the sheave assembly 20 for sensing movement of the compensation rope 24. The second optical sensor assembly 30B can be configured on the car side 44 of the sheave assembly 20 for sensing movement of the compensation rope 24. The first and second optical sensor assemblies 30A, 30B can be arranged generally in a pit area 80 of the hoistway 50.

The optical sensor assembly 30 can further include at least one of a third optical sensor assembly 30C, a fourth optical sensor assembly 30D and a fifth optical sensor assembly 30E. Each of the third, fourth and fifth optical sensor assemblies 30C, 30D and 30E can be configured for monitoring sway of the suspension rope 22. In the embodiment shown in FIG. 1, the third optical sensor assembly 30C can be positioned in the elevator system 10 proximate the suspension sheave portion 40. The fourth optical sensor assembly 30D can be positioned in the elevator system proximate the elevator car 12 such as at an upper end or top 90 of the elevator car 12. The fifth optical sensor assembly 30E can be positioned substantially midway between the suspension sheave portion 40 and the compensation sheave portion 42.

The control system 32 can generally include an elevator control system 110, a main programmable logic controller (PLC) 112, a compensation rope sensor PLC 114, a machine sensor PLC 116, a midpoint sensor PLC 118 and a car top sensor PLC 120. The compensation rope sensor PLC 114 can communicate signals to the main PLC 112 based on an input from the first and second optical sensor assemblies 30A, 30B. The machine sensor PCL 116 can communicate signals to the main PLC 112 based on an input from the third optical sensor assembly 30C. The car top sensor PLC 120 can communicate signals to the main PLC 112 based on an input from the fourth optical sensor assembly 30D. The midpoint sensor PLC 118 can communicate signals to the main PLC 112 based on an input from the fifth optical sensor assembly 30E. A user interface 130 can be provided to monitor status and modify operational requirements of the elevator system 10.

As will become appreciated herein, when excessive movement of the compensation rope 24 and/or the suspension rope 22 is detected, the respective PLC 114, 116, 118 or 120 will transmit the condition to the main PLC 112 associated with the elevator control system 110. In one configuration, all of the PLC's are connected to an Ethernet backbone on a single network. Depending on the specific condition, the main PLC 112 will signal the elevator system 10 to make one of an emergency stop, reduce speed and stop, or reduce speed. The response will inhibit potential damage to equipment and potential uncomfortable riding experiences.

Turning now to FIG. 2, an embodiment of the first optical sensor assembly 30A will be described in greater detail. The first optical sensor assembly 30A can include a first optical sensor pair 210A, a second optical sensor pair 210B, a third optical sensor pair 210C, a fourth optical sensor pair 210D, a fifth optical sensor pair 210E, a sixth optical sensor pair 210F, a first transverse optical sensor pair 212A and a second transverse optical sensor pair 212B. The first optical sensor pair 210A can include a first emitter 220A1 and a first receiver 220A2. The second optical sensor pair 210B can include a second emitter 220B1 and a second receiver 220B2. The third optical sensor pair 210C can include a third emitter 220C1 and a third receiver 220C2. The fourth optical sensor pair 210D can include a fourth emitter 220D1 and a fourth receiver 220D2. The fifth optical sensor pair 210E can include a fifth emitter 220E1 and a fifth receiver 220E2. The sixth optical sensor pair 210F can include a sixth emitter 220F1 and a sixth receiver 220F2. The first transverse optical sensor pair 212A can include a first transverse emitter 222A1 and a first transverse receiver 222A2. The second transverse optical sensor pair 212B can include a second transverse emitter 222B1 and a second transverse receiver 222B2.

According to the embodiment shown in FIG. 2, each of the first through sixth optical sensor pairs are arranged to emit a respective beam from the emitter to be received by the receiver. For example, the first emitter 220A1 is configured to emit a beam that is received by the second emitter 220A2. In the illustrated embodiment, the first through sixth optical sensor pairs 210A-210F are configured to emit beams that are parallel to each other. The first and second transverse optical sensor pairs 212A and 212B are configured to emit beams that are parallel to each other but transverse relative to the beams associated with the first through sixth optical sensor pairs 210A-210F.

In the embodiment shown, there are three compensation ropes 24A, 24B and 24C. Other arrangements are considered. The first and third optical sensor pairs 210A and 210C are arranged on opposite sides of the first compensation rope 24A. The second and fourth optical sensor pairs 210B and 210D are arranged on opposite sides of the second compensation rope 24B. The fifth and sixth optical sensor pairs 210E and 210F are arranged on opposite sides of the third compensation rope 24C. While the emitters are all identified on one side (above) of the respective first, second and third compensation ropes 24A, 24B and 24C and the receivers are all arranged on the opposite side (below) the respective first, second and third compensation ropes 24A, 24B and 24C, they may be arranged differently. For example some or all of the emitters and receivers may be arranged on opposite sides of the respective compensation ropes as shown in FIG. 2.

As used herein the term "interruption" is used to denote the blocking of a beam of light extending between a given optical sensor pair by a corresponding compensation or suspension rope. According to one configuration, if a compensation rope sways an amount significant enough to interrupt a corresponding beam between any of the optical sensor pairs, a signal is generated such as at the compensation rope sensor PLC 114 and communicated to the main PLC 112. The control system 32 controls movement of the elevator car 12 based on such detected interruptions. For example, if two adjacent compensation ropes are swaying toward each other within a predetermined time threshold, the control system 32 can perform an emergency stop on the elevator car 12. Explained further, if both the first and second pairs of optical sensors 210A and 210B detect an interruption within a threshold timeframe, the elevator car 12 is caused to stop by the control system 32. It will be appreciated that the control system 32 can be configured to perform an emergency stop upon detection of other single or combinations of detected interruptions.

With continued reference to FIG. 2, exemplary dimensions will be described. It will be appreciated that other dimensions may be used. The first and third optical sensor pairs 210A and 210C; the second and fourth optical sensor pairs 210B and 210D; and the fifth and sixth optical sensor pairs 210E and 210F can be offset by a distance 248. The distance 248 can be 2.2 inches. The first and second compensation ropes 24A and 24B; and the second and third compensation ropes 24B and 24C can be offset by a distance 250. The distance 250 can be 6.30 inches. The first and second transverse optical sensor pairs 212A and 212B can be offset a distance 256. The distance 256 can be 3.5 inches. Each of the first through sixth optical sensor pairs are positioned at a location such that the respective beam is a distance 258 away from the nearest compensation rope. The distance 258 can be 0.25 inches. Each of the first, second and third compensation ropes 24A, 24B and 24C can have a diameter 260. The diameter 260 can be 1.61 inches.

Turning now to FIG. 3, the second optical sensor assembly 30B is shown. The second optical sensor assembly 30B can be constructed similarly to the first optical sensor assembly 30A. In this regard, like components are identified with reference numerals increased by 100. It will be further appreciated that each of the optical sensor assemblies 30C, 30D and 30E may be configured similarly. The fifth optical sensor assembly 30E may include two optical sensor assemblies that monitor movement (sway) of the suspension rope 22, one on each of the car side 44 and the counterweight side 46.

Figure 4:
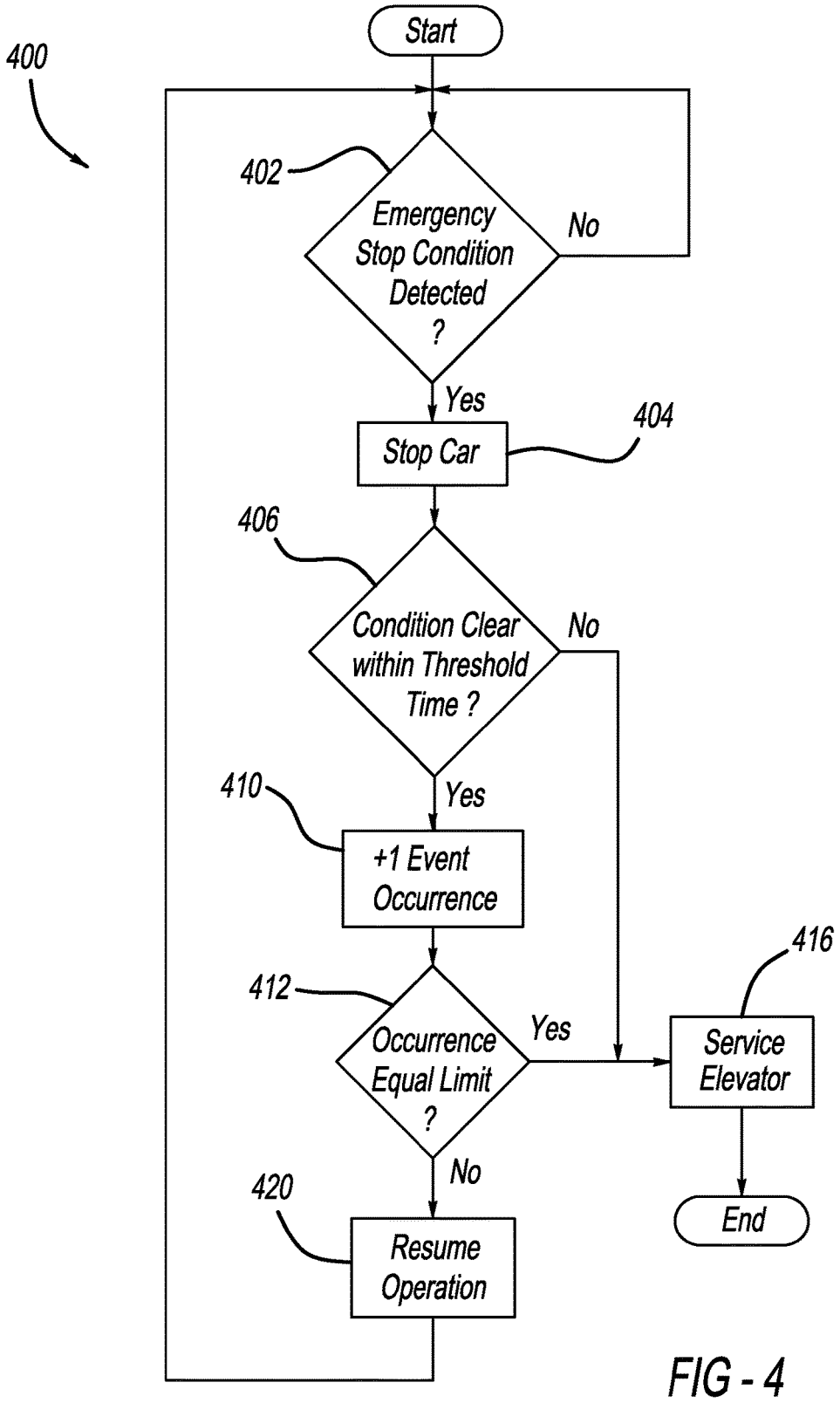
FIG. 4 shows an exemplary method of controlling an elevator system according to one embodiment of the present disclosure.

With reference now to FIG. 4, a method of controlling an elevator car 12 of the elevator system 10 according to one embodiment of the present disclosure is shown and generally identified at reference numeral 400. At 402 the control system 32 determines whether an emergency stop condition has been detected. According to one embodiment, such a condition can exist if adjacent compensation ropes have interrupted adjacent optical sensor pairs within a predetermined time threshold. In other words, an emergency stop condition may be satisfied if adjacent compensation ropes are swinging toward each other as confirmed by corresponding, adjacent optical sensor pairs.

An emergency stop condition may be satisfied in other ways. For example, in one embodiment, any one pair of optical sensors can be configured to trigger an emergency stop such as when a beam is interrupted for a given timeframe. If such an emergency stop condition has been satisfied, the control system 32 stops the elevator car 12 at 404. At 406 the control system 32 determines whether the condition has cleared within a threshold timeframe. If not, the elevator system 10 is serviced in 416. If the condition has cleared within the threshold timeframe, a counter is increased in 410. In 412 the control system 32 determines whether the occurrence limit has been reached. For example, if the counter reaches a limit (such as three events for example), the control system 32 can proceed to service the elevator system 10 in 416. If the occurrence limit has not been reached, elevator operation is resumed in 420.

Figure 5:
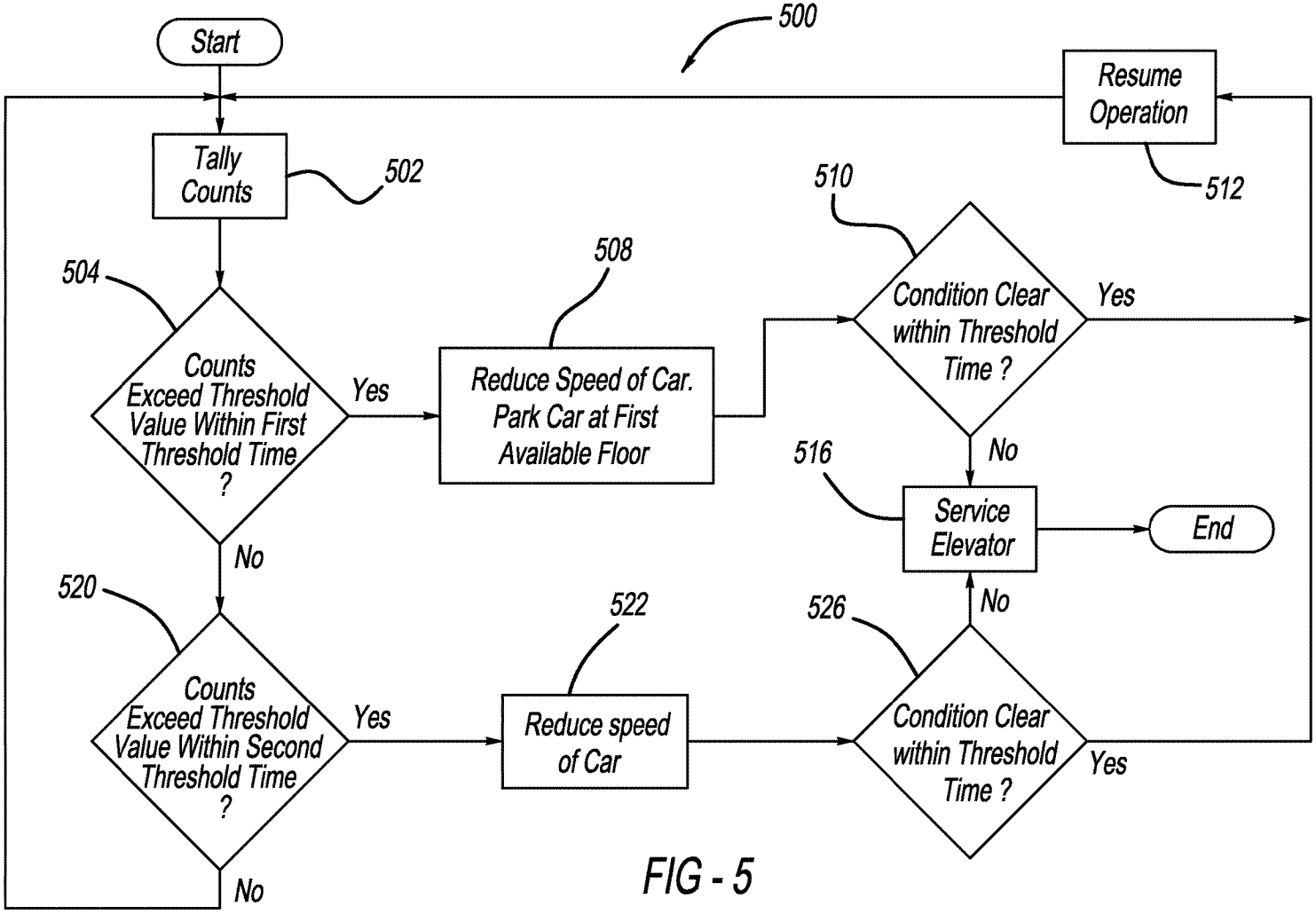
FIG. 5 shows an exemplary method of controlling an elevator system according to a second embodiment of the present disclosure.

With reference now to FIG. 5, a method of controlling an elevator car 12 of the elevator system 10 according to another embodiment of the present disclosure is shown and generally identified at reference numeral 500. It will be appreciated that the methods 400 and 500 may be carried out concurrently. At 502 the control system 32 tallies the counts. A count occurs each time an interruption occurs. Counts may be tallied for each optical sensor pair. In 504 the control system 32 determines whether the counts exceed a threshold value within a first threshold time. For example, 504 can be satisfied if five counts are tallied in a two second timeframe for any given optical sensor pair. In 508 the speed of the elevator car 12 is reduced and the elevator car is parked at the first available floor. In 510 the control system 32 determines whether the condition has cleared within a threshold time. The threshold time can be set to 120 seconds for example. If the condition has cleared, normal elevator operation resumes at 512. If the condition has not cleared, the elevator system 10 is serviced in 516.

If the counts do not exceed the threshold value in 504, the control system 32 determines whether the counts exceed a threshold value within a second threshold time. For example, 520 can be satisfied if five counts are tallied in a three second timeframe.

If the counts exceed the threshold value within the second threshold time, the speed of the elevator car 12 is reduced in 522. The control system 32 determines whether the condition has cleared within a threshold time 526. The threshold time can be set to 60 seconds for example. If the condition has cleared, normal elevator operation resumes at 512. If the condition has not cleared, the elevator system 10 is serviced in 516.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. In this regard, the ordering of method steps is not necessarily fixed, but may be capable of being modified without departing from the instant teachings. Such variations are not to be regarded as a departure from the disclosure, and all such modifications are intended to be included within the scope of the disclosure.

What is claimed is:

1. An elevator system comprising:

an elevator car;

a counterweight;

a sheave assembly having a suspension sheave portion and a compensation sheave portion;

a suspension rope passing over and guided by the suspension sheave portion, the suspension rope having a first suspension end coupled to the elevator car on a car side of the elevator system and a second suspension end coupled to the counterweight on a counterweight side of the elevator system;

a first and a second compensation rope passing around and guided by the compensation sheave portion, the first and second compensation ropes both having a respective first compensation end coupled to the elevator car on the car side and a second compensation end coupled to the counterweight on the counterweight side;

a first optical sensor assembly positioned on the counterweight side of the elevator system and having;

a first optical sensor pair including;

a first emitter and a first receiver, the first emitter configured to emit a first beam to be received by the first receiver, the first optical sensor pair configured to detect interruption of the first beam by the first compensation rope; and a second optical sensor pair arranged relative to the first optical sensor pair to detect interruption upon movement of at least one of the first and second compensation ropes toward the other of the first and second compensation ropes, the second optical sensor pair including;

a second emitter and a second receiver, the second emitter configured to emit a second beam to be received by the second receiver, the second optical sensor pair configured to detect interruption of the second beam by the second compensation rope; and a controller that controls movement of the elevator car based on the detected interruption.

2. The elevator system of claim 1, further comprising a second optical sensor assembly positioned on the car side of the elevator system, the second optical sensor comprising:

a first optical sensor pair including a first emitter and a first receiver, the first emitter configured to emit a first beam to be received by the first receiver, the first optical sensor pair configured to detect interruption of the first beam by the first compensation rope; and a second optical sensor pair arranged relative to the first optical sensor pair to detect interruption upon movement of the first and second compensation ropes toward each other, the second optical sensor pair including; a second emitter and a second receiver, the second emitter configured to emit a second beam to be received by the second receiver, the second optical sensor pair configured to detect interruption of the second beam by the second compensation rope.

3. The elevator system of claim 2, further comprising an additional optical sensor assembly having a first suspension optical sensor pair including a first suspension emitter configured to emit a first suspension beam to be received by a first suspension receiver, the first suspension optical sensor pair configured to detect interruption of the first suspension beam by the suspension rope.

4. The elevator system of claim 3 wherein the additional optical sensor assembly is positioned in the elevator system proximate the suspension sheave portion.

5. The elevator system of claim 3 wherein the additional optical sensor assembly is positioned in the elevator system proximate the elevator car.

6. The elevator system of claim 3 wherein the additional optical sensor assembly is positioned substantially midway between the suspension sheave portion and the compensation sheave portion.

7. The elevator system of claim 1 wherein the first optical sensor assembly further comprises:

a first transverse pair of optical sensors including a first transverse emitter and a first transverse receiver, the first transverse emitter configured to emit a first transverse beam to be received by the first transverse receiver, wherein the first optical sensor pair is arranged to emit the first beam in a first direction and the first transverse pair of optical sensors are arranged to emit the first transverse beam in a second direction, wherein the first and second directions are transverse relative to each other.

8. The elevator system of claim 7 wherein the first optical sensor assembly further comprises:

a third optical sensor pair including a third emitter and a third receiver, the third emitter configured to emit a third beam to be received by the third receiver, wherein the third optical sensor pair is arranged to emit the third beam in a third direction, wherein the first and third directions are parallel to each other.

9. The elevator system of claim 8 wherein the first and third optical sensor pairs are positioned on opposite sides of the first compensation rope.

10. The elevator system of claim 7 wherein the first and second transverse optical sensor pairs are offset 3.5 inches away from each other.

11. The elevator system of claim 7 wherein the first optical sensor assembly further comprises:

a second transverse pair of optical sensors including a second transverse emitter and a second transverse receiver, the second transverse emitter configured to emit a second transverse beam to be received by the second transverse receiver, wherein the first and second transverse pairs of optical sensors are positioned parallel to each other on opposite sides of the first and second compensation ropes.

12. The elevator system of claim 1 wherein the first optical sensor pair are positioned at a location such that the first beam is 0.25 inch away from the first compensation rope when the first compensation rope is in a static position.

13. An elevator system comprising:

an elevator car;

a counterweight;

a sheave assembly having a suspension sheave portion and a compensation sheave portion;

a suspension rope passing over and guided by the suspension sheave portion, the suspension rope having a first suspension end coupled to the elevator car on a car side of the elevator system and a second suspension end coupled to the counterweight on a counterweight side of the elevator system;

a first and a second compensation rope passing around and guided by the compensation sheave portion, the first and second compensation ropes both having a respective first compensation end coupled to the elevator car on the car side and a second compensation end coupled to the counterweight on the counterweight side;

a first optical sensor assembly positioned on the counterweight side of the elevator system and emitting a beam that passes between the first and second compensation ropes to detect interruption upon movement of one of the first and second compensation ropes toward the other of the first and second compensation ropes, the first optical sensor assembly having;

a first optical sensor pair including;

a first emitter and a first receiver, the first emitter configured to emit a first beam to be received by the first receiver, the first optical sensor pair configured to detect interruption of the first beam by one of the first and second compensation ropes; and a controller that controls movement of the elevator car based on the detected interruption.

14. The elevator system of claim 13, further comprising:

a second optical sensor pair arranged relative to the first optical sensor pair to detect interruption upon movement of at least one of the first and second compensation ropes toward the other of the first and second compensation ropes, the second optical sensor pair including;

a second emitter and a second receiver, the second emitter configured to emit a second beam to be received by the second receiver, the second optical sensor pair configured to detect interruption of the second beam by the second compensation rope.

15. The elevator system of claim 14 wherein the first optical sensor assembly further comprises:

a first transverse pair of optical sensors including a first transverse emitter and a first transverse receiver, the first transverse emitter configured to emit a first transverse beam to be received by the first transverse receiver, wherein the first optical sensor pair is arranged to emit the first beam in a first direction and the first transverse pair of optical sensors are arranged to emit the first transverse beam in a second direction, wherein the first and second directions are transverse relative to each other.

16. The elevator system of claim 15 wherein the first optical sensor assembly further comprises:

a second transverse pair of optical sensors including a second transverse emitter and a second transverse receiver, the second transverse emitter configured to emit a second transverse beam to be received by the second transverse receiver, wherein the first and second transverse pairs of optical sensors are positioned parallel to each other on opposite sides of the first and second compensation ropes.

17. The elevator system of claim 13, further comprising an additional optical sensor assembly is positioned in the elevator system proximate the elevator car.

18. The elevator system of claim 13, further comprising an additional optical sensor assembly is positioned substantially midway between the suspension sheave portion and the compensation sheave portion.

19. An elevator system comprising:

an elevator car;

a counterweight;

a sheave assembly having a suspension sheave portion and a compensation sheave portion;

a suspension rope passing over and guided by the suspension sheave portion, the suspension rope having a first suspension end coupled to the elevator car on a car side of the elevator system and a second suspension end coupled to the counterweight on a counterweight side of the elevator system;

a first and a second compensation rope passing around and guided by the compensation sheave portion, the first and second compensation ropes both having a respective first compensation end coupled to the elevator car on the car side and a second compensation end coupled to the counterweight on the counterweight side;

a first optical sensor assembly positioned on the elevator system and having;

a first optical sensor pair including;

a first emitter and a first receiver, the first emitter configured to emit a first beam to be received by the first receiver, the first optical sensor pair configured to detect interruption of the first beam by one of the first and second compensation ropes; and a second optical sensor pair arranged relative to the first optical sensor pair to detect interruption upon movement of at least one of the first and second compensation ropes toward the other of the first and second compensation ropes, the second optical sensor pair including;

a second emitter and a second receiver, the second emitter configured to emit a second beam to be received by the second receiver, the second optical sensor pair configured to detect interruption of the second beam by the second compensation rope; and a controller that controls movement of the elevator car based on the detected interruption.

* * * * *